US012577855B2

(12) United States Patent
Ahmed et al.

(10) Patent No.: US 12,577,855 B2
(45) Date of Patent: Mar. 17, 2026

(54) SYSTEMS AND METHODS FOR MICROBUBBLE AND NANOBUBBLE $CO_2$ AND OTHER GAS DISSOLUTION AND SEQUESTRATION IN GEOLOGICAL FORMATIONS

(71) Applicant: Saudi Arabian Oil Company, Dhahran (SA)

(72) Inventors: Zeyad Tareq Ahmed, Chassell, MI (US); Serguey Viktorov Arkadakskiy, Alberta (CA); Noushad Kunnummal, Louisville, KY (US)

(73) Assignee: Saudi Arabian Oil Company, Dhahran (SA)

( * ) Notice: Subject to any disclaimer, the term of this patent is extended or adjusted under 35 U.S.C. 154(b) by 310 days.

(21) Appl. No.: 17/939,155

(22) Filed: Sep. 7, 2022

(65) Prior Publication Data

US 2024/0084672 A1 Mar. 14, 2024

(51) Int. Cl.
*E21B 41/00* (2006.01)
*E21B 43/16* (2006.01)

(52) U.S. Cl.
CPC ..... *E21B 41/0064* (2013.01); *E21B 43/164* (2013.01)

(58) Field of Classification Search
CPC .. E21B 41/0064; E21B 43/164; E21B 43/166; E21B 43/168
See application file for complete search history.

(56) References Cited

U.S. PATENT DOCUMENTS

| | | | | |
|---|---|---|---|---|
| 8,684,085 | B2 * | 4/2014 | Kameyama | E21B 43/02 166/309 |
| 8,939,223 | B2 * | 1/2015 | Kameyama | E21B 43/164 166/402 |
| 9,279,313 | B2 * | 3/2016 | Kameyama | E21B 41/0064 |
| 11,155,462 | B2 | 10/2021 | Arkadakskiy et al. | |
| 2021/0261451 | A1 * | 8/2021 | Patton | E21B 43/164 |
| 2022/0219112 | A1 * | 7/2022 | Sigfússon | B01D 53/62 |
| 2022/0381122 | A1 * | 12/2022 | Pope | E21B 43/164 |
| 2023/0235214 | A1 * | 7/2023 | Hasan | E21B 41/0064 166/279 |

OTHER PUBLICATIONS

Uemura et al., "Injection of nanosized CO2 droplets as a technique for stable geological sequestration," Dec. 22, 2015, International Journal of Greenhouse Gas Control, pp. 62-69. (Year: 2015).*

(Continued)

*Primary Examiner* — Frederick L Lagman
(74) *Attorney, Agent, or Firm* — Dinsmore & Shohl LLP

(57) ABSTRACT

A system for waste gas sequestration in a geological formation comprises a wellbore within the geological formation, a microbubble/nanobubble generator configured to inject gaseous microbubbles of the waste gas, gaseous nanobubbles of waste gas, or both into an aqueous stream, and an injection well casing disposed within the wellbore and in fluid communication with the microbubble/nanobubble generator, wherein the injection well casing defines an open-ended passage for delivering the aqueous stream comprising the injected microbubbles and/or nanobubbles of the waste gas into the geological rock formation.

17 Claims, 2 Drawing Sheets

(56) References Cited

OTHER PUBLICATIONS

Canziani, "EcoTechnologies for Wastewatr Treatment", The International Water Associates Conference Proceedings, Jun. 23-27, 5 pages, 2014.
Gislason et al., "A brief history of CarbFix: Challenges and victories of the project's pilot phase", Energy Procedia, vol. 146, pp. 103-114, 2018.
Gunnarsson et al., "The rapid and cost-effective capture and subsurface mineral storage of carbon and sulfur at the CarFix2 site", International Journal of Greenhouse Gas Control, vol. 79, pp. 117-126, 2018.
Koide et al., "Carbon microbubbles sequestration: a novel technology for stable underground emplacement of greenhouse gases into wide variety of saline aquifers, fractured rocks and tight reservoirs", Energy Prodedia, vol. 1, pp. 3655-3662, 2009.
Meegoda et al., "Stability of Nanobubbles", Environmental Engineering Science, vol. 00, No. 00, 12 pages, 2018.
Mito et al., "Geochemical trapping of CO2 in saline aquifer storage: Results of repeated formation fluid sampling at the Nagaoka site", Energy Procedia, vol. 37, pp. 5449-5455, 2013.
Snoebjornsdottir et al., "Carbon dioxide storage through mineral carbonation", Nat Rev Earth Environ, vol. 1, pp. 90-102, 2020.
Suzuki et al., "Feasibility Study on CO2 Micro-Bubble Storage (CMS)", Energy Procedia, vol. 37, pp. 6002-6009, 2013.
Wang et al., "Preparation and Properties of CO2 Micro-Nanobubble Water Based on Response Surface Methodology", Applied Sciences, vol. 11, 15 pages, 2021.
Xue et al., "Microbubble carbon dioxide injection for enhanced dissolution in geological sequestrtion and improved oil recovery", Energy Procedia, vol. 63, pp. 7939-7946, 2014.
Zhou et al., "Long-Term Stability of Different Kinds of Gas Nanobubbles in Deionized and Salt Water", Materials, vol. 14, No. 1808, 20 pages, 2021.
First Examination Report, dated Nov. 13, 2024, pp. 1-8, received in corresponding Saudi Arabian Application No. 123450326.

* cited by examiner

SYSTEMS AND METHODS FOR MICROBUBBLE AND NANOBUBBLE $CO_2$ AND OTHER GAS DISSOLUTION AND SEQUESTRATION IN GEOLOGICAL FORMATIONS

FIELD

Embodiments disclosed herein generally relate to improved waste gas sequestration in geological formations and more specifically, to waste gas sequestration in reactive geological formations via waste gas dissolution in water using microbubbles and/or nanobubbles.

TECHNICAL BACKGROUND

Sequestration of gases is desired in a variety of applications, including but not limited to, the reduction of greenhouse gases and gas storage. Many industries, including but not limited to $H_2$ or ammonia production, power generation, cement production, and water desalinization produce $CO_2$ and other harmful gases, and current methods of $CO_2$ sequestration using $CO_2$ capture in water (like scrubbing) prior to injecting the gas saturated aqueous fluid into geological formations are generally inefficient. Thus, a system and method to more effectively and efficiently dissolve water soluble gases like $CO_2$ in water for the purposes of trapping and sequestering those in geological formations is needed.

The deposition and subsequent sequestration of these gases often require drilling a hole from the surface into the desired geological formations known as a wellbore. Once the wellbore hole is formed, the dissolved gas solution can be injected into the geological formations, where the dissolved waste gases will be either trapped and sequestered in the pore spaces of the rock in a process known as solubility trapping or, should the geological formation comprise in part or entirely of reactive mineral or amorphous phases (i.e. volcanic glass), to react with those phases and to form stable secondary compounds in a process known as mineralization, whereby the gases are permanently sequestered in a solid mineral form.

SUMMARY $CO_2$ sequestration in geological formations can be water-based, meaning that it is dependent on water to act as a carrier and a trapping or reaction medium for the target gas ($CO_2$). The systems and methods involved in water-based gas sequestration can alter the level of saturation of $CO_2$ in the carrier water, so water-based $CO_2$ sequestration in geological formations is often limited by the amount of $CO_2$ that can be dissolved in the carrier water. As a result, large volumes of water are needed to carry adequate volumes of dissolved gas for cost effective sequestration, the volumes of carrier water thus presenting a large part of the cost related to this sequestration method. There is a current and ongoing need to more permanently and more economically sequester harmful gases like $CO_2$ in the subsurface. As described herein, embodiments include microbubble and nanobubble generators positioned within a sequestration system to generate gaseous microbubbles/nanobubbles, increasing the mass loading of $CO_2$ into an aqueous stream saturated with $CO_2$ and delivering the resulting aqueous mixture into a geological formation.

According to one or more embodiments of the present disclosure, a system for waste gas sequestration in a geological formation comprises a wellbore within a geological formation, a microbubble/nanobubble generator configured to inject gaseous microbubbles of the waste gas, gaseous nanobubbles of waste gas, or both into an aqueous stream, and an injection well casing disposed within the wellbore and in fluid communication with the microbubble/nanobubble generator, wherein the injection well casing defines an open-ended passage for delivering the aqueous stream comprising the injected microbubbles and/or nanobubbles of the waste gas into the geological rock formation.

According to further embodiments of the present disclosure, a method for sequestering waste gases in a geologic formation, the method comprising injecting waste gas via gaseous microbubbles and/or gaseous nanobubbles into an aqueous stream and passing the aqueous stream comprising the injected gaseous microbubbles and/or gaseous nanobubbles through an injection well casing to contact the geologic formations and sequester the waste gas in the geologic formation.

It is to be understood that both the preceding general description and the following detailed description describe various embodiments and are intended to provide an overview or framework for understanding the nature and character of the claimed subject matter. Additional features and advantages of the embodiments will be set forth in the detailed description, and, in part, will be readily apparent to persons of ordinary skill in the art from that description, which includes the accompanying drawings and claims, or recognized by practicing the described embodiments. The drawings are included to provide a further understanding of the embodiments, and together with the detailed description, serve to explain the principles and operations of the claimed subject matter. However, the embodiments depicted in the drawings are illustrative and exemplary in nature, and not intended to limit the claimed subject matter.

BRIEF DESCRIPTION OF DRAWINGS

The following detailed description may be better understood when read in conjunction with the following drawings, in which.

DETAILED DESCRIPTION

Figure 1:
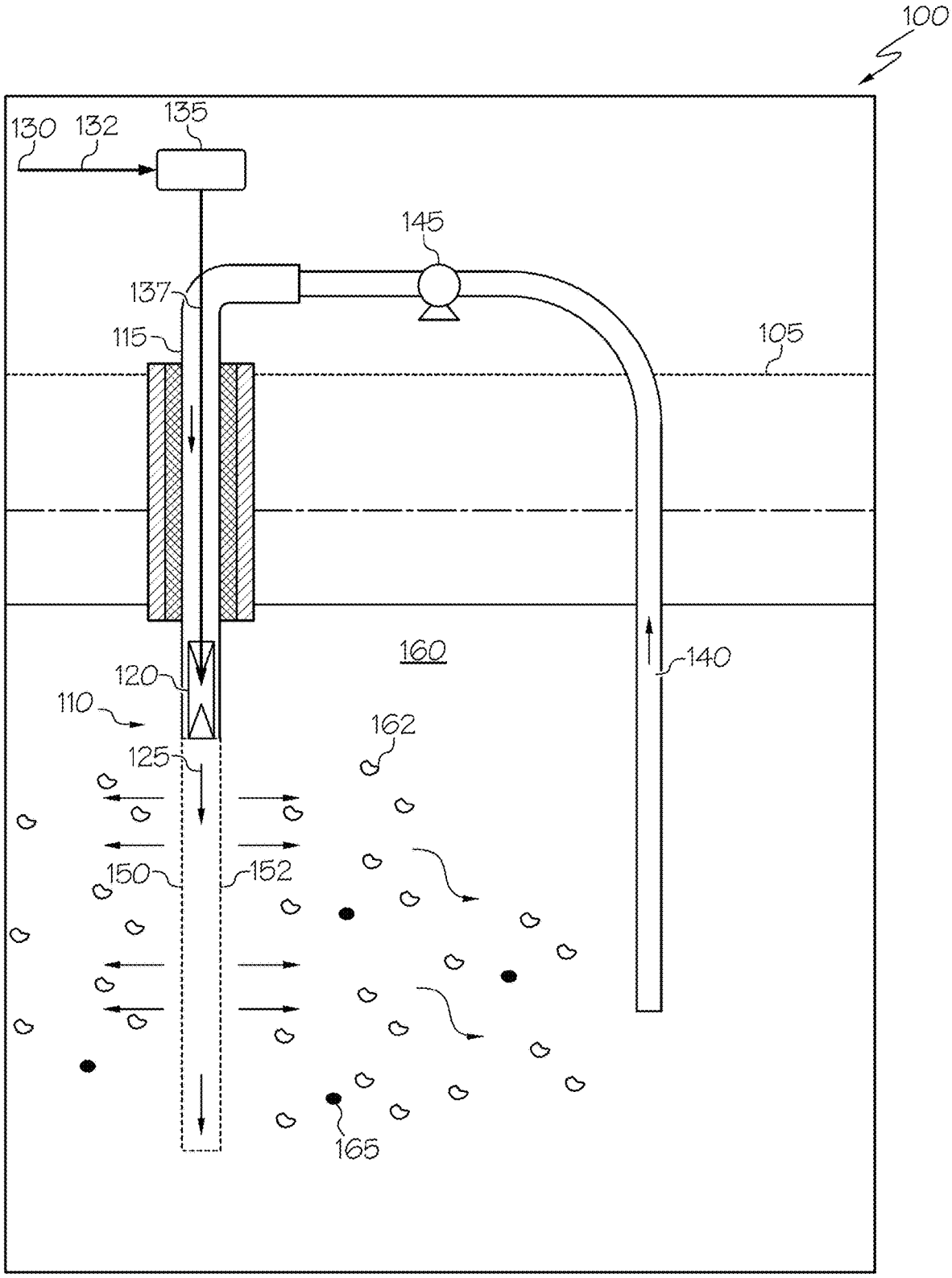
FIG. 1 is a schematic diagram of an embodiment of a system for gas sequestration, as described herein.

The present disclosure is generally directed to systems and methods for sequestering carbon dioxide ($CO_2$) or other water-soluble waste gases in subsurface geological formations through the use of gaseous microbubbles and/or gaseous nanobubbles. The systems may generally include a wellbore disposed within the geological formation, a casing disposed within the wellbore and extending downhole a depth within the wellbore, a microbubble/nanobubble generator, a target gas source, an injection water source, a plurality of pumps operable to deliver carrier water to the microbubble generator and into the wellbore, a compressor operable to deliver the target gas under pressure to the microbubble/nanobubble generator, and an open-ended passage for delivering the aqueous mixture into the geological formation.

As used throughout this disclosure, the term "wellbore" refers to a bored well capable of receiving the injection water stream or other aqueous streams and solutions. The wellbore can be placed horizontally, vertically, or positioned at any angle within the section of the geological formation that is targeted for injection. The wellbore creates a path capable of permitting both fluids and apparatuses to traverse between the surface and the subsurface rock formation. In addition to defining the void of volume comprising the wellbore, the wellbore wall acts as the interface through which the aqueous stream or other fluids can traverse between the wellbore and the rock formation. Furthermore, the design and setup of the wellbore can be dependent upon the specific properties of the system, including but not limited to, the characteristics of the geological rock formation, the depth of the injection zone in the rock formation, and the specific properties of the injection water.

As used throughout this disclosure, the term "geological formation" refers to a subsurface body of rock that can include but is not limited to any water saturated permeable rock formation or a reservoir capable of transmitting and storing/sequestering the injected aqueous mixture. Examples include formations consisting of sedimentary, igneous or metamorphic rocks. Respectively, the term "reactive rock formation" refers to a geological formation, which consist in part or entirely of mineral and amorphous (e.g. volcanic glass) phases capable of chemically reacting with the injected aqueous mixture to produce stable secondary compounds including but not limited to carbonates. The "reactive" component of a "reactive rock formation" can include but is not limited to rocks, minerals, amorphous phases or fragments thereof of mafic, and ultramafic rock of igneous origin as well as any combinations thereof.

As used throughout this disclosure, the term "gas" can refer to any gas or mixture of gases. In the current embodiments, the target gas can include but is not limited to, $CO_2$, $H_2S$, or $SO_2$, as well as any combinations of these gases. "Gas" can also refer to "waste gas", which as used throughout the present disclosure, refers to any gas that may be processed, stored, transported, or combinations thereof.

As used throughout this disclosure, the term "gaseous" refers to the state of matter with the properties and characteristics of a gas and does not refer to the supercritical state of matter.

As used throughout this disclosure, the term "microbubble" refers to a bubble ranging from about 1 micrometer to 10 micrometers in diameter. The small size of these microbubbles gives them unique physical and chemical properties, including but not limited to, increased surface area of up to 600 times of larger (macro) bubbles produced by conventional diffusers, decreased buoyancy, decreased velocity of motion, and increased resistance to bursting/collapse at higher pressures. Furthermore, the term "nanobubble" as used throughout this disclosure refers to bubbles with a diameter of less than 200 nanometers that exhibit properties including but not limited to, increased reactivity and stability due to their high specific surface area, high stagnation time, which enhances the mass transfer efficiency and reactions at the gas-liquid interface, and decreased coalescence due to repulsive forces generated by electric charges at the gas-liquid interface.

Now referring to FIG. 1, an example system 100 that may be suitable for use with the methods and/or apparatuses described herein is schematically depicted. The system generally comprises a wellbore 110 within a geological formation 160, a microbubble/nanobubble generator 120 within the casing 115 disposed within the wellbore 110 that generates gaseous microbubbles and/or gaseous nanobubbles of a target gas 130 via a target gas stream 132 to an injection water stream 140, forming an aqueous mixture 125 comprising gaseous microbubbles/nanobubbles and water saturated with the gas/gases the microbubbles and nanobubbles consist of. The aqueous mixture stream 125 flows downward the depth of the wellbore 110 and into the injection well 150, where it exits the injection well 150 through an open hole/passage 152. From there, the aqueous mixture 125 enters the geological formation 160. Within the geological formation 160 the aqueous mixture 125 will become trapped and sequestered in the porous space of the rock.

Figure 2:
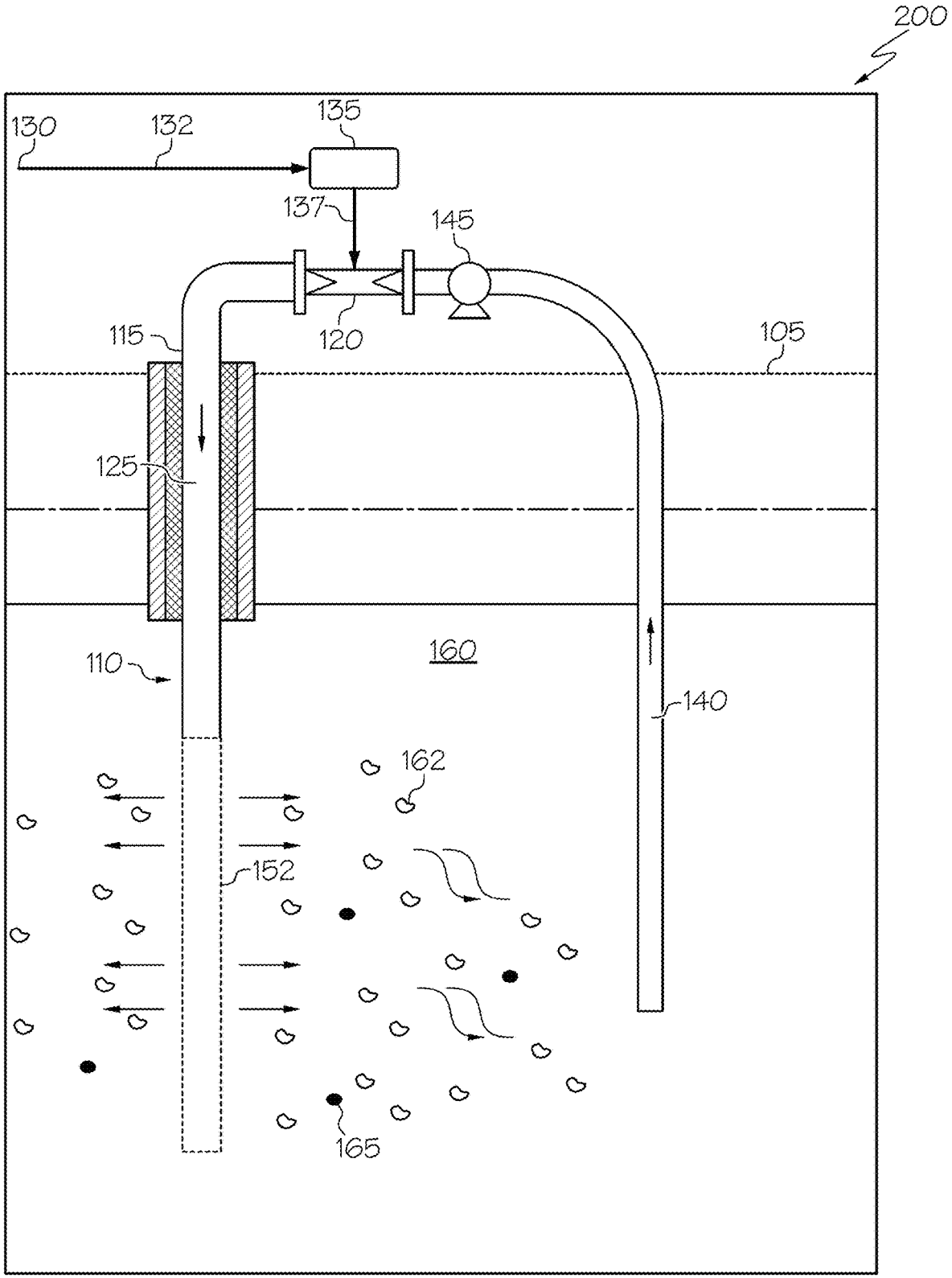
FIG. 2 is a schematic diagram of another embodiment of a system for gas sequestration, as described herein.

Referring to FIG. 2, an example system 200 that may be suitable for use with the methods and/or apparatuses described herein is schematically depicted. The example system 200 differs from the system 100 of FIG. 1 in that the microbubble/nanobubble generator 120 is located proximate to the surface 105, whereas the microbubble/nanobubble generator 120 of system 100 is disposed within the casing 115 within wellbore 110.

In embodiments, the gas from the target gas source 130 can comprise $CO_2$. In embodiments, the gas from the gas source 130 consists of $CO_2$. In other embodiments, the gas from the target gas source 130 can comprise $H_2S$. In embodiments, the gas from the target gas source 130 can comprise $SO_2$. In embodiments, the gas from the target gas source 130 can comprise $CO_2$, $H_2S$, $SO_2$, and any combinations of these gases.

In embodiments, the target gas source 130 may also impact the amount of water needed to adequately dissolve the target gas and the design and operation of the microbubble/nanobubble generator 120. The type of gas source 130 may also impact the type of material and casing 115 surrounding the wellbore 110. For example $H_2S$ is more soluble than $CO_2$, thus lesser volumes of water are needed to sequester a unit volume of $H_2S$ than the volume of water needed to sequester an equal volume of $CO_2$ Regarding the material that the casing (and other well equipment) is made of, since water soluble gases such as $CO_2$ and $H_2S$ (a.k.a. acid gases) vary in terms of their corrosivity, more corrosive gases require material with higher corrosion resistance, such as a casing made of a specific (higher) steel grade, or of steel coated with corrosion resistant material, as well as one made entirely of nonmetallic material.

Ultimately, the goal is to load as much dissolved gas into the formation as possible without compromising the injection operations. Therefore, the suitable amount of bubbles is the maximum amount that can be safely loaded to the already gas saturated carrier water without allowing bubble coalescence and the formation of buoyant free gas ($CO_2$) phase that could cause a well blowout, or upon entering the rock formation, could significantly reduce wellbore permeability by filling the pore spaces in the rock. Therefore, the suitable amount of nanobubbles/microbubbles depends on many factors, including but not limited to the performance of the bubbles generators, the consistency of the bubbles sizes and their resistance to coalescence into macrobubbles, which depends in part on the injection rate, controlled by the physical properties of the formation (permeability), among other factors.

In embodiments, the specification and type of water pump 145 used to source and inject the carrier water stream 140 may also be impacted by the type of target gas 130 and the type of water comprising the injection water stream 140. For example, water corrosivity is always the major factor controlling for the pump specifications. The chemical properties that define the corrosivity of the target gas and/or carrier as well as the resulting aqueous mixture will determine the specifications of the carrier water sourcing and well equipment including but not limited to the water pump, other wellhead and casing material, etc. Also, the location of the water pump in the system determines whether dissolved gas can be in contact with the pump and may thus impact the water pump specifications.

Regarding the specific pressures under which the pump is operable, a carrier water to $CO_2$ ratio would be from 25 to 65 cubic meters of water per ton of injected $CO_2$, which is achieved when the pressure at which $CO_2$ dissolves in the carrier (fresh) water is varied from 30 and 10 bar, respectively. Injection flowrates at such pressures cannot be predicted, as these will vary depending on the porosity/permeability of the injection zone. In other words, wells completed in less permeable rocks will have to be operated at lesser flow rates, while wells completed in highly permeable rocks can be operated at higher flow rates, while maintaining/adjusting pressures that provide the optimal water to gas ratios. Nevertheless, the minimum operating injection pressure should be kept above 10 bar, so that the quantities of dissolved $CO_2$ delivered to the injection zone are maximized, while minimizing carrier water volumes required for sequestration. Should injection pressure be lower than 10 bar, higher volumes of water may be needed.

In embodiments, the gas pump/compressor 135 can compress the gas from the target gas source 130 and pump it to the microbubble/nanobubble generator 120 to produce gaseous microbubbles/nanobubbles into the injection water stream 140 to form an aqueous mixture of water and gaseous microbubbles/nanobubbles 125. In embodiments, the operation of the compressor 135 relies on the pressure from the received gas from the target gas source 130, the needed gas pressure at the site of injection in the injection well 150, and the needed pressure at the microbubble/nanobubble generator 120. For example, in the system 100 where the microbubble/nanobubble generator 120 is placed within the casing 115 of the wellbore 110, if the pressure of the gas received at this depth in the injection well is adequate for injection, then the operation of the compressor 135 will be less needed than in example system 200. In the system 200, the microbubble/nanobubble generator 120 is placed closer to the surface 105, so the need for compression of the gas from the target gas source 130 will be greater than in system 100. If the pressure of the gas is not adequate for injection at its current depth, then the gas will need to be compressed by the compressor 145 to reach an adequate pressure proportionate to the depth at which it is being injected. Furthermore, the pressure is also dependent on the specifications and the performance of the bubble generator. In any case, the gas ($CO_2$) pressure needs to be slightly higher than the water pressure at the bubble/water mixing point. For $CO_2$, this pressure needs to be lower than about 75 bars, because this is the approximate pressure at which $CO_2$ gas turns to a supercritical fluid, which may complicate operations. Furthermore, compressing gas close to or beyond about 75 bars is costly and unnecessary for the purposes of the method described herein.

In embodiments, the injection water stream 140 may be sourced from a production well. In embodiments, the injection water stream 140 may also be sourced from another suitable source such as seawater or treated wastewater. Furthermore, the injection water stream 140 may be sourced with certain specific properties including but not limited to temperature and salinity of the source water, which can impact the solubility of $CO_2$ and other target gases as well as the design, material and operation of the microbubble/nanobubble generator 120.

In other embodiments, there may be an operational controller (not shown) that can modulate and optimize certain aspects of the system, including but not limited to the injection water flow rate/pressure, the target gas 130 loading rate, or both.

In embodiments, a fraction of the aqueous mixture 125 that reacts with the reactive minerals 162 within the reactive geological formation 160 may be pumped to the surface as a return water stream and recycled. At the surface, this fraction of water can be used to monitor the rates of reaction.

In some embodiments, the geological formation 160 may comprise any rock that is permeable enough to transmit and store the injected aqueous mixture, while a reactive rock formation 162 may comprise a permeable rock that comprises entirely or in part of a reactive mineral and/or amorphous phases. In embodiments, the reactive component of the geological formation 160 may contain reactive mineral and/or amorphous phases 162 comprising mafic rocks (e.g. basalts). In other embodiments, the reactive component of the geological formation 160 may contain reactive minerals 162 comprising ultramafic rocks. In further embodiments, the reactive component of the geological formation 160 may contain reactive minerals and/or amorphous phases 162 consisting of mafic rock, ultramafic rock, or any combination thereof.

In embodiments comprising a reactive rock formation 162, the aqueous mixture 125 enters the geological formation 160. Within the geological formation 160, the components of the aqueous mixture 125 may react with the reactive rock formation, wherein stable secondary compounds are formed. Mineralization within a reactive rock formation as discussed herein permanently sequesters the waste gas.

In embodiments, the design and setup of the water injection well 150 may depend on the physical properties of the geological formation 160. For example, the permeability of the formation dictates the cost-effective rate of water injection, and in return, governs the amount of $CO_2$ that can be sequestered per well. Furthermore, the design and setup of injection well 150 may be dependent on the depth of the permeable and/or reactive rock zone, the properties of the injection water stream 140, and other factors.

Embodiments disclosed herein can optimize the dissolution of water-soluble gases, such as but not limited to carbon dioxide, hydrogen sulfide, sulfur dioxide, or mixtures thereof in an aqueous solution for the purpose of gas sequestration in a geological formation that optionally comprises a reactive component; enhance the energy efficiency of gas dissolution by dissolving gases at or near their solubility limits using less energy than other methods; enhance the solubility of gases within the wellbore as the added microbubbles/nanobubbles will collapse and dissolve into the carrier water deeper inside the well or inside the geological formation where the hydrostatic pressure is higher, which expands the water solubility of the target gases; increase the mass loading of $CO_2$ or other gases into the aqueous injection stream due to the microbubbles/nanobubbles providing an additional supply of gas within the wellbore by delayed collapsing and dissolution within the aqueous injection stream deep inside the injection well or inside the geological formation; reduce the chance of accidental operational issues such as those related to the formation of a buoyant gas phase inside the well or the formation.

Currently, the preferred mechanism for sequestering water-soluble gases like $CO_2$ and $H_2S$ by solubility trapping of those gases in a geological formation 160, or by their mineralization in a reactive rock formation such as basalts and other reactive rocks, involves the dissolution of the gas in water via scrubbing in scrubbing towers, which may require the use and injection of larger than optimal volumes of carrier water due to the incomplete dissolution of $CO_2$ in water. In contrast, the current disclosure utilizes a microbubble/nanobubble generator 120 to deliver the $CO_2$ or other target gases in a more efficient manner to achieve maximum gas saturation at lower energy, oversaturate the injection water stream 140 with the gas phase, and provide extended contact between the $CO_2$ (or other gas)-saturated aqueous mixture 125 and the geological formation 160 exposed to the open hole 155, which improves the overall sequestration efficiency.

A first aspect of the present disclosure is directed to a system for waste gas sequestration in a geological formation comprising a wellbore within the geological formation, a microbubble/nanobubble generator configured to inject gaseous microbubbles of the waste gas, gaseous nanobubbles of waste gas, or both into an aqueous stream, and an injection well casing disposed within the wellbore and in fluid communication with the microbubble/nanobubble generator, wherein the injection well casing defines an open-ended passage for delivering the aqueous stream comprising the injected microbubbles and/or nanobubbles of the waste gas into the geological rock formation.

A second aspect of the present disclosure may include the first aspect, wherein the geological formation comprises permeable rock.

A third aspect of the present disclosure may include either the first or second aspect, wherein the geological formation comprises reactive rock.

A fourth aspect of the present disclosure may include any one of the first through third aspects, wherein the geological formation reactive rock and permeable rock.

A fifth aspect of the present disclosure may include any one of the first through fourth aspects, wherein the system further comprises a compressor operable to deliver the waste gas under pressure to a microbubble/nanobubble generator.

A sixth aspect of the present disclosure may include any one of the first through fifth aspects, wherein the system further comprises one or more pumps operable to deliver the carrier water to the microbubble/nanobubble generator.

A seventh aspect of the present disclosure may include any one of the first through sixth aspects, wherein the waste gas comprises $CO_2$.

An eighth aspect of the present disclosure may include any one of the first through seventh aspects, wherein the microbubble/nanobubble generator is placed inside the injection well casing or proximate an upper surface of the wellbore.

A ninth aspect of the present disclosure may include any one of the first through eighth aspects, wherein the system further comprises an operational controller operable to control injection water flow rate, or target gas loading rate, or both.

A tenth aspect of the present disclosure may include any one of the first through ninth aspects, wherein the system further comprises a monitor at the surface gauges the reaction rate and byproducts through monitoring recycled water, if the injection targets a reactive rock.

An eleventh aspect of the present disclosure is directed to a method for sequestering waste gases in a geologic formation, the method comprising injecting waste gas via gaseous microbubbles and/or gaseous nanobubbles into an aqueous stream and passing the aqueous stream comprising the injected gaseous microbubbles and/or gaseous nanobubbles through an injection well casing to contact the geologic formations and sequester the waste gas in the geologic formation.

A twelfth aspect of the present disclosure may include the eleventh aspect, wherein the geological formation comprises permeable rock.

A thirteenth aspect of the present disclosure may include either the eleventh or the twelfth aspect, wherein the geologic formation comprises reactive rock.

A fourteenth aspect of the present disclosure may include the any one of the eleventh through thirteenth aspects, wherein the sequestering of the waste gas is achieved by producing stable secondary compounds from the reaction of reactive rock with the dissolved waste gas upon collapse of the gaseous microbubbles and/or gaseous nanobubbles.

A fifteenth aspect of the present disclosure may include any one of the eleventh through fourteenth aspects, wherein the reactive rock component comprises mafic rock, ultramafic rock, and combinations thereof.

A sixteenth aspect of the present disclosure may include any one of the eleventh through fifteenth aspects, wherein the waste gas comprises $CO_2$.

It will be apparent to persons of ordinary skill in the art that various modifications and variations can be made without departing from the scope disclosed herein. Since modifications, combinations, sub-combinations, and variations of the disclosed embodiments, which incorporate the spirit and substance disclosed herein, may occur to persons of ordinary skill in the art, the scope disclosed herein should be construed to include everything within the scope of the appended claims and their equivalents.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter disclosed herein has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A system for waste gas sequestration in a geological formation comprising:

a wellbore within the geological formation;

a microbubble/nanobubble generator configured to inject gaseous microbubbles of the waste gas, gaseous nanobubbles of waste gas, or both into an aqueous stream, wherein the microbubble/nanobubble generator is placed proximate an upper surface of the wellbore; and an injection well casing disposed within the wellbore and in fluid communication with the microbubble/nanobubble generator, wherein the injection well casing defines an open-ended passage for delivering the aqueous stream comprising the injected microbubbles and/or nanobubbles of the waste gas into the geological rock formation.

2. The system of claim 1, wherein the geological formation comprises reactive rock.

3. The system of claim 1, wherein the geological formation comprises reactive rock and permeable rock.

4. The system of claim 1, further comprising a compressor operable to deliver the waste gas under pressure to a microbubble/nanobubble generator.

5. The system of claim 1, further comprising one or more pumps operable to deliver the carrier water to the microbubble/nanobubble generator.

6. The system of claim 1, wherein the waste gas comprises $CO_2$.

7. The system of claim 1, further comprising an operational controller operable to control injection water flow rate, or target gas loading rate, or both.

8. The system of claim 1, wherein a monitor at the surface gauges the reaction rate and byproducts through monitoring recycled water, if the injection targets a reactive rock.

9. The system of claim 1, wherein the gaseous microbubbles have a diameter from 1 micrometer to 10 micrometers and the gaseous nanobubbles have a diameter of less than 200 nanometers.

10. The system of claim 1, wherein the waste gas comprises $CO_2$, $H_2S$, and $SO_2$.

11. A method for sequestering waste gases in a geologic formation, the method comprising:

injecting waste gas via gaseous microbubbles and/or gaseous nanobubbles into an aqueous stream; and passing the aqueous stream comprising the injected gaseous microbubbles and/or gaseous nanobubbles through an injection well casing to contact the geologic formations and sequester the waste gas in the geologic formation;

wherein the aqueous stream comprising the injected gaseous microbubbles and/or gaseous nanobubbles is formed prior to entering the injection well casing.

12. The method of claim 11, wherein the geological formation comprises reactive rock.

13. The method of claim 12, wherein the sequestering of the waste gas is achieved by producing stable secondary compounds from the reaction of reactive rock with the dissolved waste gas upon collapse of the gaseous microbubbles and/or gaseous nanobubbles.

14. The method of claim 12, wherein the reactive rock component comprises mafic rock, ultramafic rock, and combinations thereof.

15. The method of claim 11, wherein the waste gas comprises $CO_2$.

16. The method of claim 11, wherein the gaseous microbubbles have a diameter from 1 micrometer to 10 micrometers and the gaseous nanobubbles have a diameter of less than 200 nanometers.

17. The method of claim 11, wherein the waste gas comprises $CO_2$, $H_2S$, and $SO_2$.

* * * * *